United States Patent [19]

Cutler

[11] Patent Number: 4,648,968

[45] Date of Patent: Mar. 10, 1987

[54] FLOATING COVER TANK WITH GUIDES FOR VERTICAL DISPLACEMENT OF THE COVER

[75] Inventor: Donald R. Cutler, Earlville, Ill.

[73] Assignee: Chicago Bridge & Iron Company, Oak Brook, Ill.

[21] Appl. No.: 813,679

[22] Filed: Dec. 26, 1985

[51] Int. Cl.[4] ..... B65D 88/46; B65D 88/34; C02F 11/04

[52] U.S. Cl. ..... 210/218; 210/DIG. 9; 435/287; 48/197 A; 220/222; 220/224; 220/227

[58] Field of Search ..... 210/DIG. 9, 218, 603; 435/167, 287, 801; 48/197 A, 111; 220/216, 222, 223, 224, 225, 227; 422/184

[56] References Cited

U.S. PATENT DOCUMENTS

| | | | |
|---|---|---|---|
| 2,050,915 | 8/1936 | Beddoes et al. | 210/DIG. 9 |
| 2,600,237 | 6/1952 | Graham | 220/224 |
| 2,919,047 | 12/1959 | Fino | 220/222 |
| 3,185,335 | 5/1965 | Lecler | 220/222 |
| 3,307,733 | 3/1967 | De Bock | 220/226 |
| 4,154,358 | 5/1979 | Nayler et al. | 220/224 |
| 4,378,437 | 3/1983 | Cook | 210/DIG. 9 |
| 4,391,705 | 7/1983 | Cook et al. | 210/DIG. 9 |

*Primary Examiner*—Benoit Castel

*Attorney, Agent, or Firm*—Marshall, O'Toole, Gerstein, Murray & Bicknell

[57] ABSTRACT

A collecting and treating tank which holds liquid and in which a vertically movable cover floats on the liquid or on a gas layer above the liquid, comprising a tank having a vertical cylindrical circular wall, a bottom at and joined to the wall, and a circular cover which fits loosely inside the circular wall so that it is vertically displaceable with change in liquid and/or gas volume beneath the cover; and a plurality of cover guides, spaced radially around the cover edge, which are adapted to maintain the cover periphery spaced from the tank wall; said cover guides being faced with a solid polymeric layer which is slippery and has a low coefficient of friction so that the cover is readily displaceable vertically solely with change in volume of liquid, gas or both beneath the cover.

22 Claims, 19 Drawing Figures

FLOATING COVER

FLOATING COVER

FIG. 5
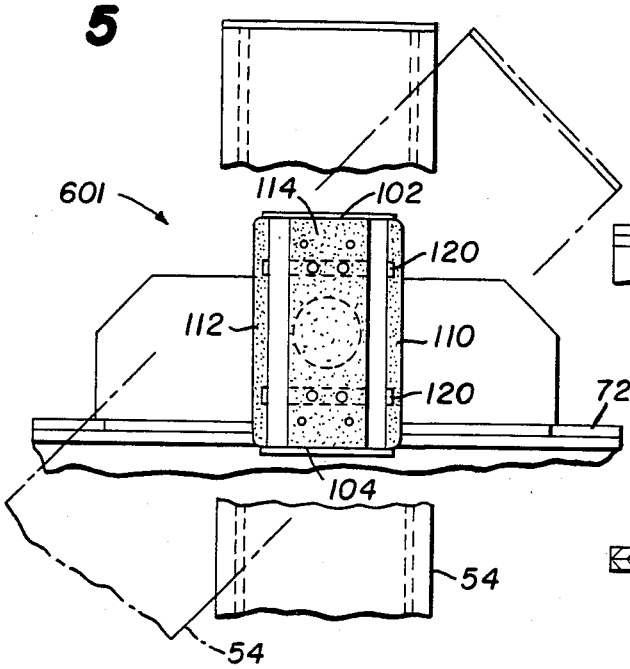
FIG. 6
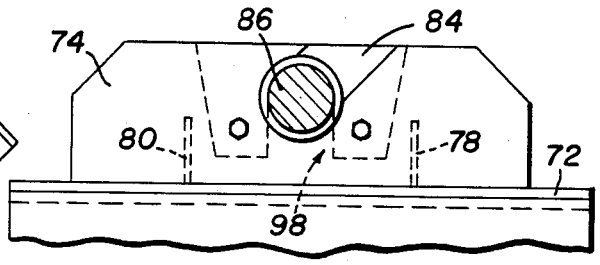
FIG. 7
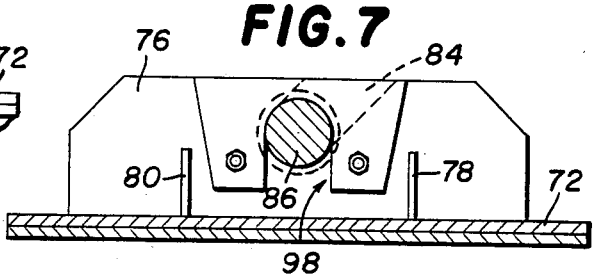
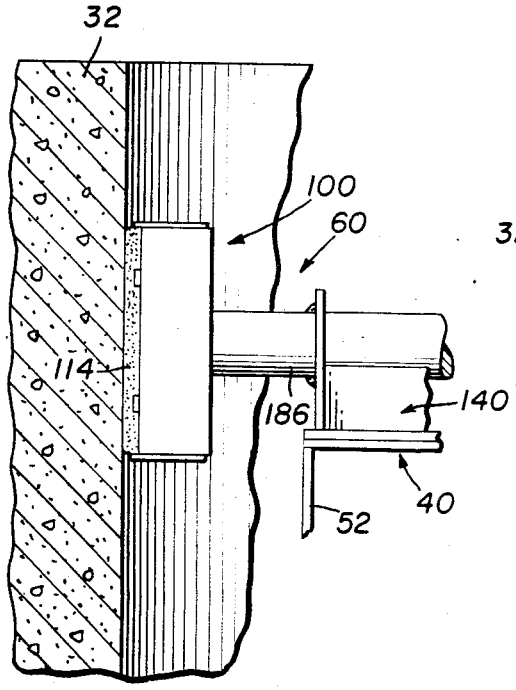
FIG. 15
FIG. 13
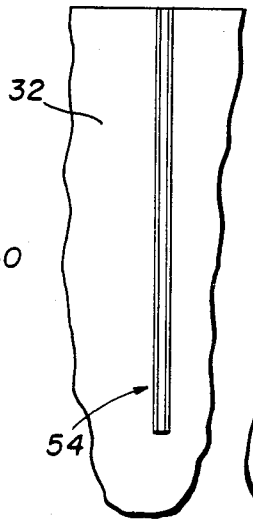
FIG. 14
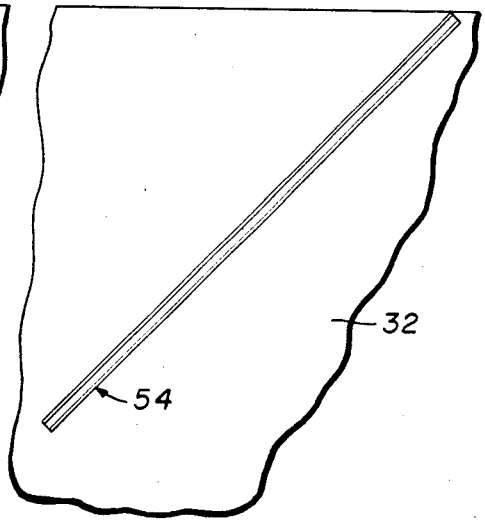

FLOATING GASHOLDER

FLOATING COVER TANK WITH GUIDES FOR VERTICAL DISPLACEMENT OF THE COVER

This invention relates to liquid collecting and treating tanks with floating covers. More particularly, this invention is concerned with a liquid collecting and treating tank having a floating cover and cover guides to facilitate vertical movement of the cover in the tank.

BACKGROUND OF THE INVENTION

Sewage plants produce large amounts of sewage sludge. To reduce the volume of sludge to be disposed of it is often collected and subjected to anaerobic digestion in tanks with floating horizontal covers which are vertically movable with change in volume of liquid, gas, or both, beneath the cover.

In one type of floating cover tank used to collect and treat sludge, the cover floats directly on the liquid sludge and gas produced by the digesting sludge is removed through a gas take-off housing and vented to the atmosphere. Another type of tank in which liquid sludge is anaerobically digested utilizes what is often referred to as a gasholder cover. The gasholder cover traps gas, produced in the sludge digestion process, beneath the cover thereby enabling it to float above the liquid sludge on the variable volume gas bubble.

In each of the described types of tank, the horizontally positioned floating cover is vertically movable with change in volume of liquid, gas, or both, beneath the cover. To aid in vertical movement of the cover it has been conventional practice to utilize metal rollers. In some tanks, the rollers have been mounted on the cover edge so as to contact the tank wall and/or one or more guide tracks on the tank. In other tanks, particularly those having gasholder covers, rollers have been mounted on the tank wall so that they engage vertical guide tracks on the cover periphery. The environmental conditions where the rollers are located lead to corrosion of the bearings, whether they be ball, roller or sleeve bearings, so that the rollers tend to seize to the supporting shaft. The rollers, being fixed and unable to roll, slide along the guide track or other surface on which they were intended to roll. Because of the small wear area of the rollers and high loads applied per unit area, the rollers wear quickly and vertical movement of the cover becomes restricted. A need accordingly exists for an improved floating cover tank with cover guides which avoids or minimizes the problems inherently present in the systems now in use.

SUMMARY OF THE INVENTION

According to the invention there is provided a collecting and treating tank which holds liquid and in which a vertically movable cover floats on the liquid or on a gas layer above the liquid, comprising a tank having a vertical cylindrical circular wall, a bottom at and joined to the wall, and a circular cover which fits loosely inside the circular wall so that it is vertically displaceable with change in liquid and/or gas volume beneath the cover; and a plurality of cover guides, spaced radially around and connected to the cover edge, which are adapted to contact and center the cover in, and maintain the cover periphery spaced from, the tank wall. The cover guides are faced with a solid polymeric layer, which is adapted to contact the tank wall or guide track, which is slippery and has a low coefficient of friction with the tank wall inside surface or guide track, so that the cover is readily displaceable vertically solely with change in volume of liquid, gas or both beneath the cover.

Alternatively, cover guides can be spaced radially around and be connected to the tank circular wall and be adapted to contact and guide the floating cover in the tank. Tank wall mounted guides can be the only guides used or they can be used in combination with guides mounted on the cover. Cover guides mounted on the tank wall can be positioned to nest or mate with vertical or helical guide track means fixed to the periphery of the cover.

The tank can have at least one guide track means fixed to the tank wall inside surface so that one of the cover guides can nest with the guide track means and thereby restrict rotation of the cover about a vertical axis.

The guide track means can be a vertical or helical structural member, especially a channel member having a bottom and two side walls. The cover guide can have solid polymeric layers adapted to fit inside and slide against the channel member bottom and two side walls. The portion of the cover guide in the channel member can have the general shape of a rectangular parallelepiped, which desirably can rotate about a horizontal axis.

BRIEF DESCRIPTION OF THE DRAWINGS

FIG. 5 is an end view of the cover guide taken along the line 5—5 of FIG. 4;

FIG. 6 is a sectional view taken along the line 6—6 of FIG. 4;

FIG. 7 is a sectional view taken along the line 7—7 of FIG. 4;

FIG. 13 is an elevational view of a vertical channel guide track mounted on the inside surface of the tank wall;

FIG. 14 is an elevational view of a helical channel guide track set an angle or pitch of about 45°;

FIG. 15 is a side elevational view of a cover guide mounted on a cover with the cover guide front face covered by a polymeric layer adapted to contact the tank inside surface;

DETAILED DESCRIPTION OF THE DRAWINGS

To the extent it is reasonable and practical, the same or similar elements which appear in the various views of the drawings will be identified by the same numbers.

Figure 1:
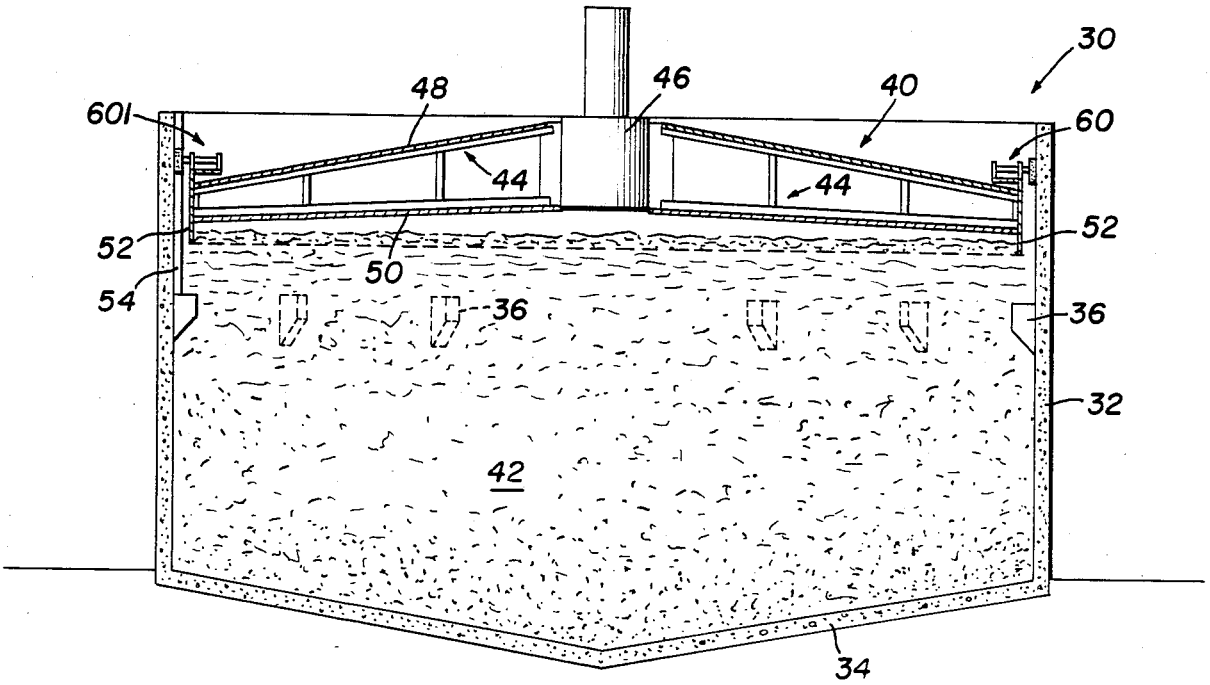
FIG. 1 is a vertical sectional view of a sludge digesting tank with a cover which floats directly on liquid sludge in the tank.
Figure 2:
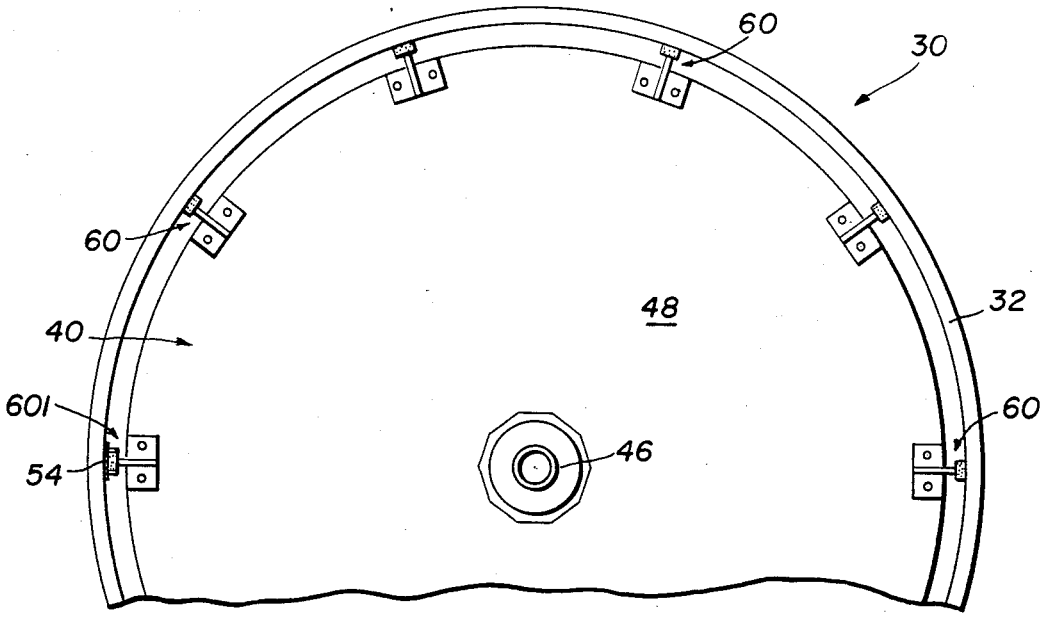
FIG. 2 is a plan view, partially broken away, of the tank and cover shown in FIG. 1.
Figure 3:
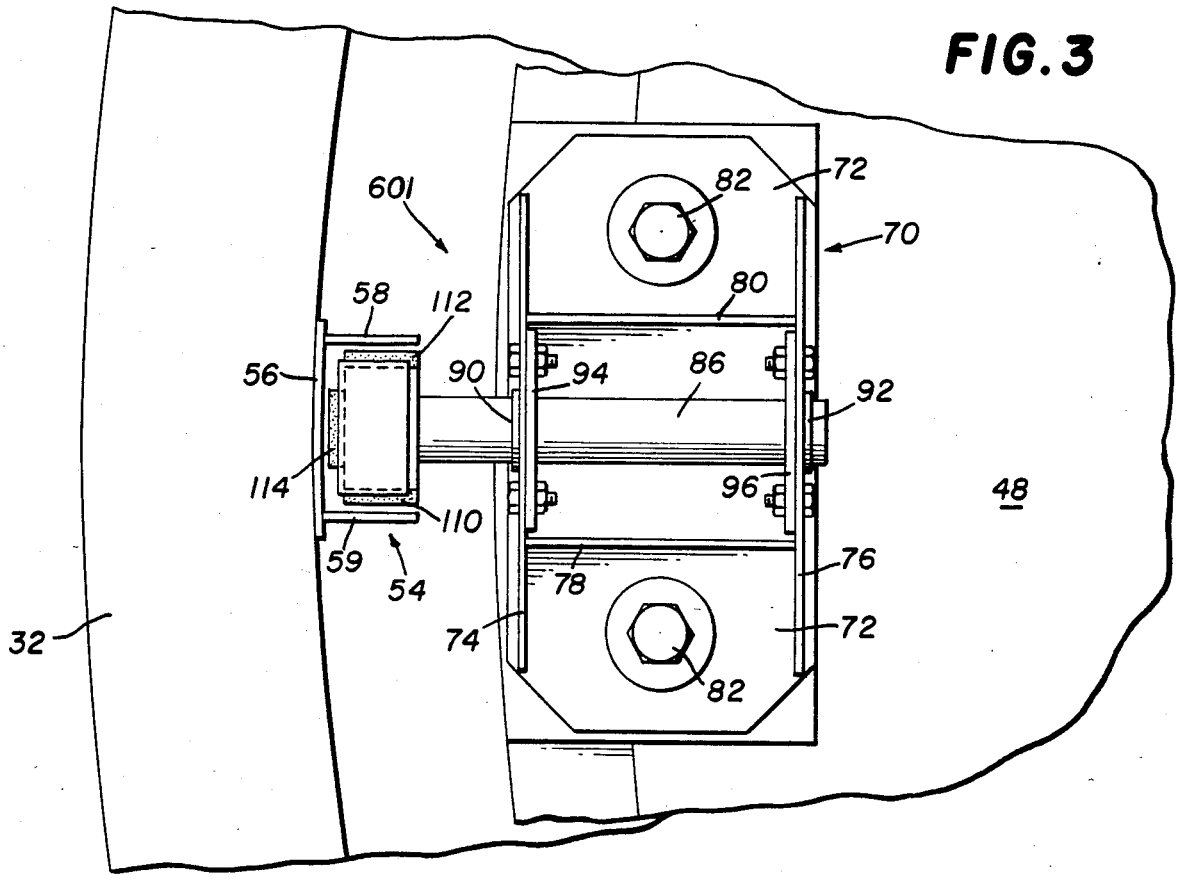
FIG. 3 is a plan view of the cover guide used on the cover shown in FIGS. 1 and 2.
Figure 4:
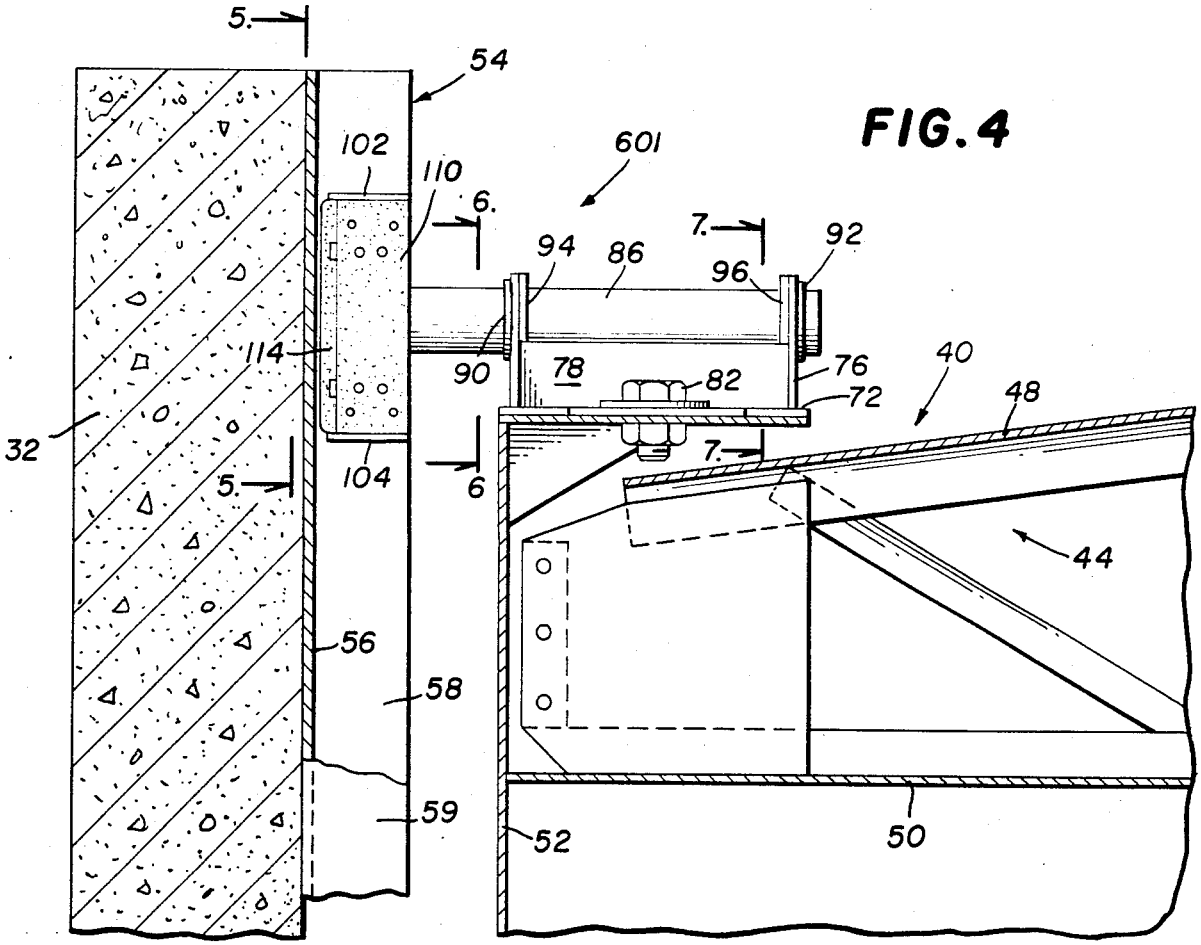
FIG. 4 is an elevational view of the cover guide shown in FIG. 3.
Figure 8:
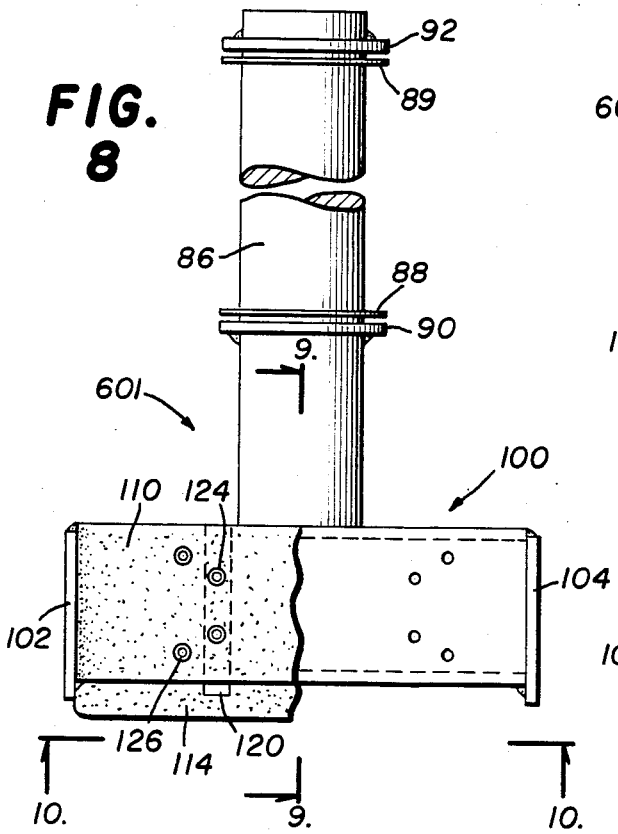
FIG. 8 is a view of one side of the cover guide shown in FIGS. 5 to 7.
Figure 9:
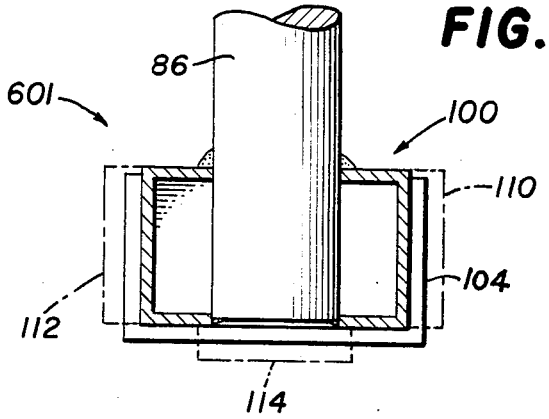
FIG. 9 is a sectional view taken along the line 9—9 of FIG. 8.
Figure 10:
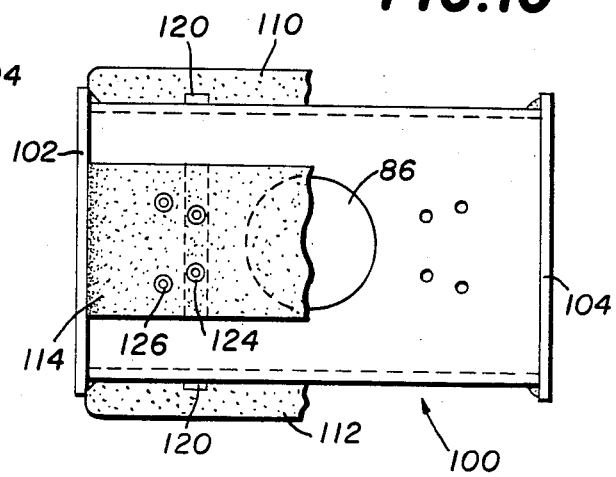
FIG. 10 is a front view of the cover guide shown in FIG. 8 taken along the line 10—10.
Figure 11:
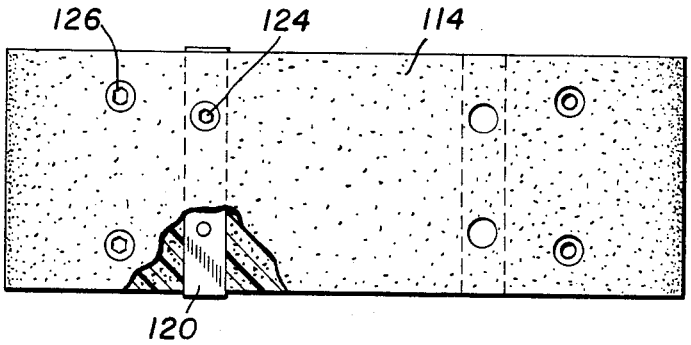
FIG. 11 is an enlarged plan view of a polymeric layer or pad used on the cover guide shown in FIGS. 8 to 10.
Figure 12:
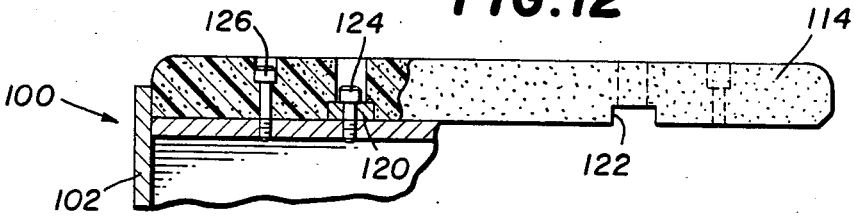
FIG. 12 is a side view, partially in section, of the polymeric layer or pad shown in FIG. 11.

With reference initially to FIGS. 1 and 2, the anaerobic sludge digester tank 30, which can be part of a sewage treatment plant, has a vertical circular cylindrical concrete wall 32 which extends upwardly from the periphery of conically concave concrete bottom 34. The inside surface of wall 32 has a plurality of radially spaced apart corbels 36 positioned at the same elevation to provide support for floating cover 40 when the liquid sludge 42 volume in the tank goes below a level which no longer floats the cover.

Floating cover 40 includes a plurality of radially positioned trusses 44 extending outwardly from gas dome 46 to the outer edge of the cover. The tops of the trusses 44 support a roof 48 while the bottoms of the trusses support a ceiling plate 50. Vertical circular cylindrical rim plate 52 is connected to the radial outer ends of trusses 44. The diameter of rim plate 52 is slightly smaller than the inside diameter of tank wall 32 so as to permit vertical displacement of the cover with change in liquid sludge volume in the tank. The bottom portion of rim plate 52 extends into the liquid sludge and thereby aids in collecting gas produced beneath ceiling plate 50. The gas is collected in dome 46 and then disposed of.

To facilitate vertical displacement of the floating cover 40 and to keep it centered in the tank wall 32 a plurality of cover guides 60 are radially positioned around the top edge of floating cover 40. Additionally, a cover guide 601 is also positioned on the cover edge but this guide nests with a track 54 to prevent unrestricted rotation of the floating cover about a vertical axis.

The cover guide 601 is illustrated in FIGS. 3 to 8. A guide support bracket 70 includes horizontal plate 72, a pair of spaced apart vertical plates 74,76 joined to plate 72 and a pair of lateral braces 78,80 joined to plates 72,74,76. The bracket 70 is connected to the edge of cover 40 by bolts 82.

The vertical plates 74,76 have identical slanted cut out slots 84 (FIGS. 6 and 7) which have curved ends to provide support for shaft 86. The shaft 86 has two axially movable thrust washers 88,89 (FIG. 8) and two fixed collars 90,92. The collar 90 fits against the outside of plate 74 (FIGS. 3 and 4) and collar 92 fits against the outside of plate 76. Two identical shaft retaining plates 94,96 maintain the shaft 86 in slots 84. Each of the plates 94,96 has an inverted U-shaped slot 98 into which shaft 86 fits with minimum clearance. Plate 94 is securely bolted to plate 74 with thrust washer 88 (FIG. 8) positioned between collar 90 and plate 74. Similarly, plate 96 is securely bolted to plate 76 with thrust washer 89 (FIG. 8) positioned between collar 92 and plate 76. When so positioned, shaft 86 is free to rotate in a full circle with very limited axial movement.

The outer end of shaft 86 supports a structural tubing section 100 which is rectangular in cross-section and longer than it is wide so that it constitutes a rectangular parallelepiped (FIGS. 8 to 12). The ends of tubing section 100 are covered by end plates 102,104 which are made oversize so as to provide shear strips against which the ends of guide layers or pads 110,112,114 can press. Guide layers 110,112 are positioned on the vertical side faces, and layer or pad 114 is positioned on the front face, of tubing section 100. The guide layers 110,112,114 can be made the same size and shape so as to be interchangeable.

Each face of tubing section 100 having a layer or pad is provided with two shear strips 120 which fit into mating grooves 122 in the bottom surface of each layer or pad. The shear strips 120 are joined to tubing section 100 by cap screws 124. Cap screws 126 are used to fasten the layers or pads 110,112,114 to tubing section 100.

The layers or pads 110,112,114 can be made of a solid polymeric material, and desirably a material which is inherently slippery and has a low coefficient of friction with the tank wall or any guide track it contacts. A specific solid polymeric material suitable for the intended use is ultra high molecular weight polyethylene.

The described cover guide 601 fits into track 54, which constitutes a channel member having a bottom 56 and sides 58,59. Track 54 can be positioned vertically as shown in FIG. 13 or helically, such as at an angle of about 45°, as shown in FIG. 14. As the cover is vertically displaced, rotation of the cover about a vertical axis is restricted by the track, whether vertical or at an angle.

The floating cover 40 shown in FIGS. 1 and 2 is equipped with only one guide member 601. However, additional guide members 601 and tracks 54 can be included as appropriate.

The guide members 60 mounted on floating cover 40 are a simplified version of guides 601 and are intended to be used when it is unnecessary to use an associated guide track. As shown in FIG. 15, shaft 186 is fixedly mounted to a bracket 140 on the edge of the floating cover 40. The shaft 186 does not rotate nor is it axially movable. Rectangular tubular section 100 is fixedly secured to the end of shaft 186 so as not to rotate. Pad or layer 114 is secured to the front face of tubular section 100 in the same manner as previously described. The layer 114 is adapted to contact the inside surface of tank wall 32 as may be necessary to aid vertical displacement of the floating cover. Since no guide track is intended to be used with guide member 60 there is no need in this embodiment to put layers or pads of polymeric material on the sides of tubular section 100.

FIGS. 16 to 19 illustrate the application of the previously described guides 60 and 601 to tanks having floating gasholder covers used to trap gas, above a variable liquid volume, so that the gas can be used in a sewage plant for digester heaters or other gas consuming equipment in the plant. In this embodiment, the tank bottom and wall are as previously described in conjunction with FIGS. 1 and 2.

The floating gasholder cover 200 includes radial trusses 202 which support a metal roof 204 and a peripheral vertical circular skirt 206 which extends downwardly into the liquid volume 208 in the tank. A gas volume 210 is collected above the liquid 208 and beneath roof 204 from which it is removed through gas take-off housing 212. The lower portion of skirt 206 is strengthened by diagonal braces 214.

A plurality of vertical or helical guide tracks 54 are attached to the outer surface of skirt 206 in equally spaced apart arrangement. A cover guide 601 is mounted on the top of tank wall 32 adjacent each track 54 so that the track and cover guide nest together in the manner previously described. As the floating gasholder cover 200 is displaced vertically with change in gas volume 210, or liquid volume 208, or both, the tracks 54 are displaced vertically an equal distance while the cover guides 601 remain stationary so that there is relative sliding between these nesting members.

Figure 16:
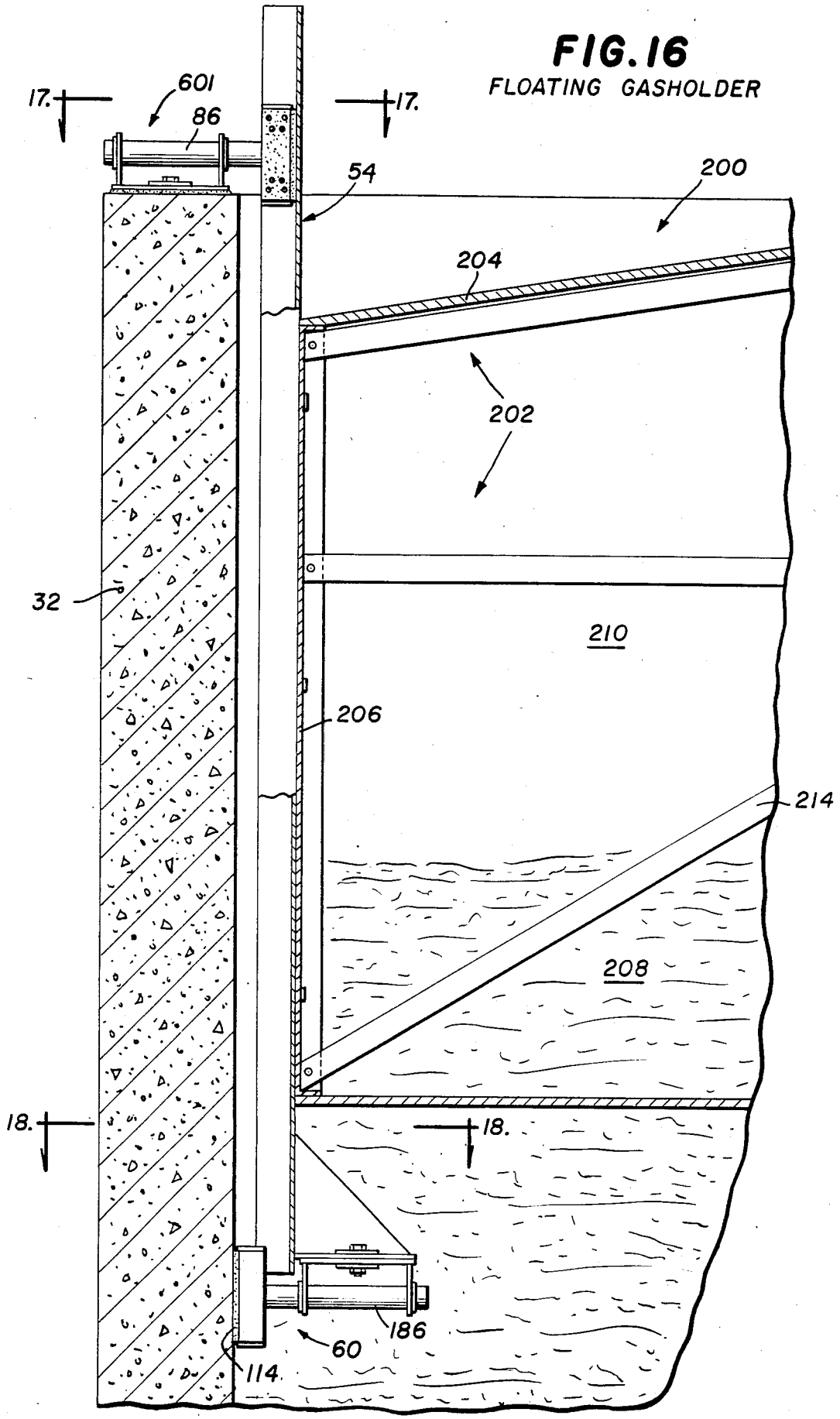
FIG. 16 is a vertical sectional view of the peripheral edge portion of a gasholder tank with a cover which floats on a volume of gas beneath the cover and above a volume of liquid in the tank.
Figure 17:
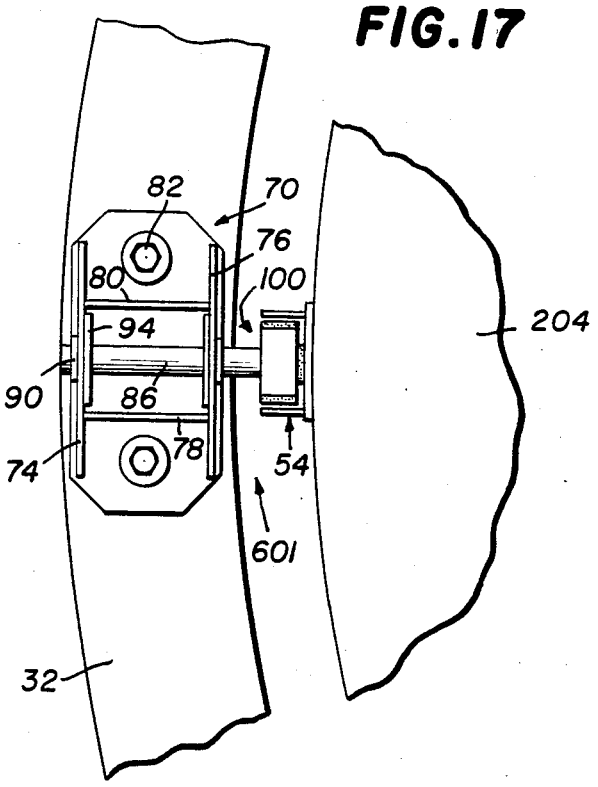
FIG. 17 is a plan view, taken along the line 17—17 of FIG. 16, of a cover guide mounted on the top of the tank wall.
Figure 18:
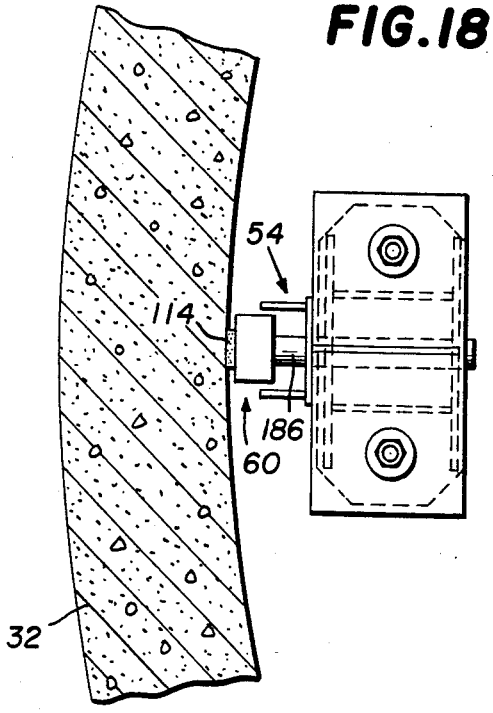
FIG. 18 is a sectional view, taken along the line 18—18 of FIG. 16, showing a cover guide mounted on the bottom of the cover skirt and adapted to contact the tank inside surface.
Figure 19:
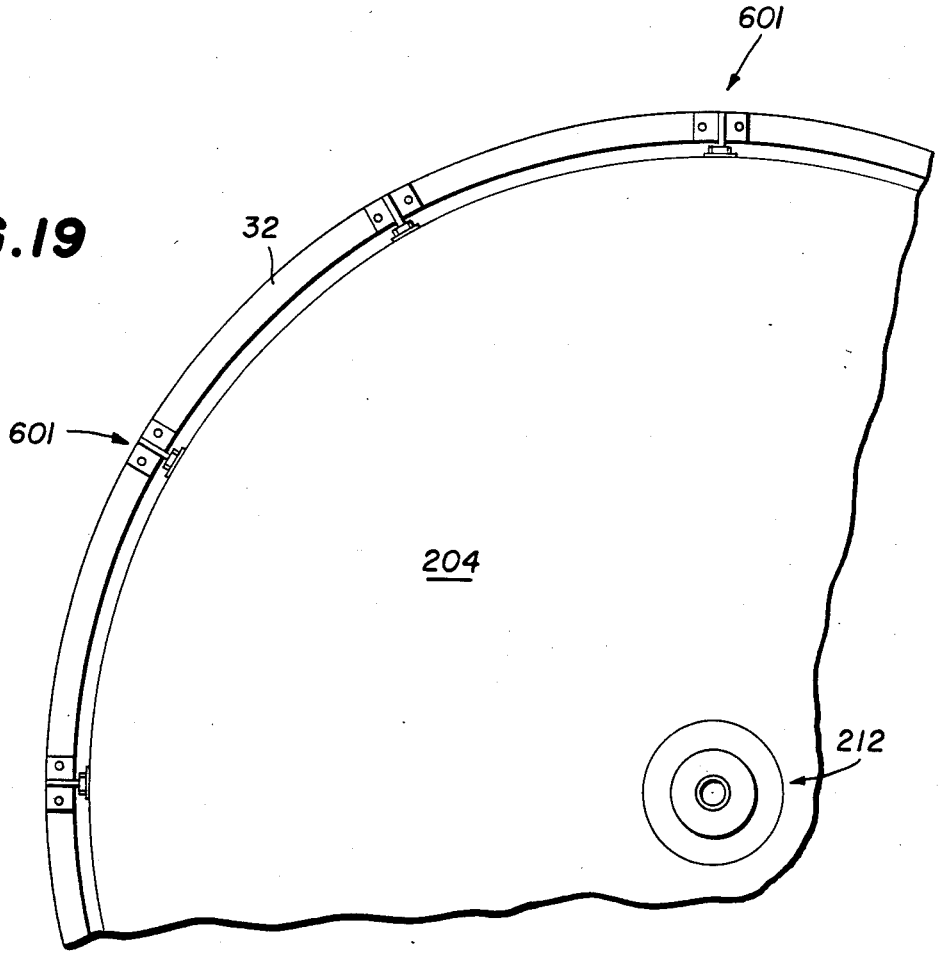
FIG. 19 is a plan view, partially broken away, of the tank and cover shown in FIG. 16 and showing the spacing of the cover guides on the tank wall.

To keep floating gasholder cover 200 from tilting, cover guides 60 may be attached to the lower end of some or all of the tracks 54 as shown in FIG. 16 so as to have the face layer 114 close to, or in contact with, the tank wall inside surface.

The foregoing detailed description has been given for clearness of understanding only, and no unnecessary limitations should be understood therefrom, as modifications will be obvious to those skilled in the art.

What is claimed is:

1. A collecting and treating tank which holds liquid and in which a vertically movable cover floats on the liquid or on a gas layer above the liquid, comprising:

a tank having a vertical cylindrical circular wall, a bottom at and joined to the wall, and a circular cover which fits loosely inside the circular wall so that it is vertically displaceable with change in liquid and/or gas volume beneath the cover;

a plurality of cover guides, spaced radially around and peripherally spaced apart along and connected to the cover edge, which are adapted to contact and center the cover in, and maintain the cover periphery spaced from, the tank wall;

said tank having at least one guide track means fixed to the tank wall inside surface with one of the cover guides nesting with the guide track means thereby restricting rotation of the cover about a vertical axis; and said cover guides being faced with a solid polymeric layer, which is adapted to contact the tank wall, which is slippery and has a low coefficient of friction with the tank wall inside surface, so that the cover is readily displaceable vertically solely with change in volume of liquid, gas or both beneath the cover.

2. A tank according to claim 1 in which the guide track means comprises a vertical structural member.

3. A tank according to claim 2 in which the vertical structural member is a channel member which has a bottom and two side walls and the cover guide has solid polymeric layers adapted to fit inside and slide against the channel member bottom and two side walls.

4. A tank according to claim 3 in which the portion of the cover guide in the channel member is in the general shape of a rectangular parallelepiped.

5. A tank according to claim 4 in which the rectangular parallelepiped portion can rotate about a horizontal axis.

6. A tank according to claim 1 in which the guide track means is a helical structural member.

7. A tank according to claim 6 in which the helical structural member is a channel member which has a bottom and two side walls and the cover guide has solid polymeric layers adapted to fit inside and slide against the channel member bottom and two side walls.

8. A tank according to claim 7 in which the portion of the cover guide in the channel member is in the general shape of a rectangular parallelepiped.

9. A tank according to claim 8 in which the rectangular parallelepiped portion can rotate about a horizontal axis.

10. A tank according to claim 1 including secondary cover guides spaced radially around and connected to the tank circular wall and adapted to contact and center the cover in the tank; and said secondary cover guides being faced with a solid polymeric layer which is slippery and has a low coefficient of friction.

11. A tank according to claim 10 in which the cover has a plurality of guide track means fixed to the periphery of the cover, and a secondary cover guide nests with each of the guide track means.

12. A tank according to claim 11 in which each guide track means comprises a vertical structural member.

13. A tank according to claim 12 in which each vertical structural member is a channel member which has a bottom and two side walls and the cover guide has solid polymeric layers adapted to fit inside and slide against the channel member bottom and two side walls.

14. A tank according to claim 13 in which the portion of the secondary cover guide in the channel member is in the general shape of a rectangular parallelepiped.

15. A tank according to claim 14 in which the rectangular parallelepiped portion can rotate about a horizontal axis.

16. A tank according to claim 11 in which each guide track means comprises a helical structural member.

17. A tank according to claim 16 in which each helical structural member is a channel member which has a bottom and two side walls and the cover guide has solid polymeric layers adapted to fit inside and slide against the channel member bottom and two side walls.

18. A tank according to claim 17 in which the portion of the secondary cover guide in the channel member is in the general shape of a rectangular parallelepiped.

19. A tank according to claim 18 in which the rectangular parallelepiped portion can rotate about a horizontal axis.

20. A collecting and treating tank which holds liquid and in which a vertically movable cover floats on the liquid or on a gas layer above the liquid, comprising:

a tank having a vertical cylindrical circular wall, a bottom at and joined to the wall, and a circular cover which fits loosely inside the circular wall so that it is vertically displaceable with change in liquid and/or gas volume beneath the cover;

a plurality of cover guides spaced radially around and horizontally spaced apart along and connected to the tank circular wall and adapted to contact and center the cover in the tank;

said cover having a plurality of guide track means fixed to the periphery of the cover with a cover guide nesting with each of the guide track means; and said cover guides being faced with a solid polymeric layer which is slippery and has a low coefficient of friction with the tank wall inside surface.

21. A tank according to claim 20 in which each guide track means comprises a vertical structural member.

22. A tank according to claim 20 in which each guide track means comprises a helical structural member.

* * * * *